United States Patent [19]

Schweinsberg

[11] 4,074,450

[45] Feb. 21, 1978

[54] BINDER FOR DATA CARRIER HOLDERS

[76] Inventor: Dieter Klaus-Jürgen Schweinsberg, 8631 Lautertal-Unterlauter, Germany

[21] Appl. No.: 732,014

[22] Filed: Oct. 13, 1976

[30] Foreign Application Priority Data

Apr. 26, 1976 Germany ..... 2618261

[51] Int. Cl.[2] ..... G09F 13/00

[52] U.S. Cl. ..... 40/403

[58] Field of Search ..... 40/102, 104.17, 72, 40/73.2

[56] References Cited

U.S. PATENT DOCUMENTS

| | | | |
|---|---|---|---|
| 1,074,886 | 10/1913 | Massey | 40/104.17 |
| 1,388,080 | 8/1921 | Welbon | 40/104.17 |
| 3,469,333 | 9/1969 | Roberts | 40/104.17 |

*Primary Examiner*—Russell R. Kinsey
*Assistant Examiner*—Wenceslao J. Contreras

[57] ABSTRACT

A binder for data carrier holders which have a plurality of pockets to receive said carriers, each holder being pivotably mounted about one of its edges in the binder, the binder having slots receiving the ends of holder stub axles with sufficient clearance to permit the holders to spread away from each other once the binder is opened, such spreading being assisted by biasing members of the holders.

3 Claims, 3 Drawing Figures

BINDER FOR DATA CARRIER HOLDERS

The present invention relates to a binder housing a certain number of data carrier holders.

BACKGROUND OF THE INVENTION

It is common practice to file data carriers, as punched cards, microfiches, magnetic cards and the like by means of data carrier holders comprising one or several pockets whereinto such data carriers may be slipped. It is suitable to combine several of such holders in a binder. Heretofore, such binders had the drawback that, when opened, they were instable such that, when opened at an appropriate holder to remove a data carrier or to refile it, the binder will automatically close due to the bias exerted by the other holders usually rigidly clamped at their edges adjacent the binder back member.

SUMMARY OF THE INVENTION

It is the object of the invention to provide a binder which, when opened, presents the holders housed therein in such a manner that the data carriers may easily be removed or slipped into the holder pockets thus reducing the danger of wrong filing. Generally, this is achieved by such a design of the binder and the holders that the latter, pivotably connected to the binder back member, may upon opening of the binder slide along the back member thereof parallel to their pivotal axes, the mounting means in the binder having sufficient clearance to permit such movement. In result, the holders will spread away from each other whereever the binder will have been opened, and such unfolding will be assisted by resilient bias of the pocket-like holders which bias tends to open each pocket at its slip-in slot. The data carriers may have a tendency to fall off such widely opened slot but this may be prevented by the provision of tongue members exerting a wedging action upon a filed data carrier.

DESCRIPTION OF THE EMBODIMENT

Figure 1:
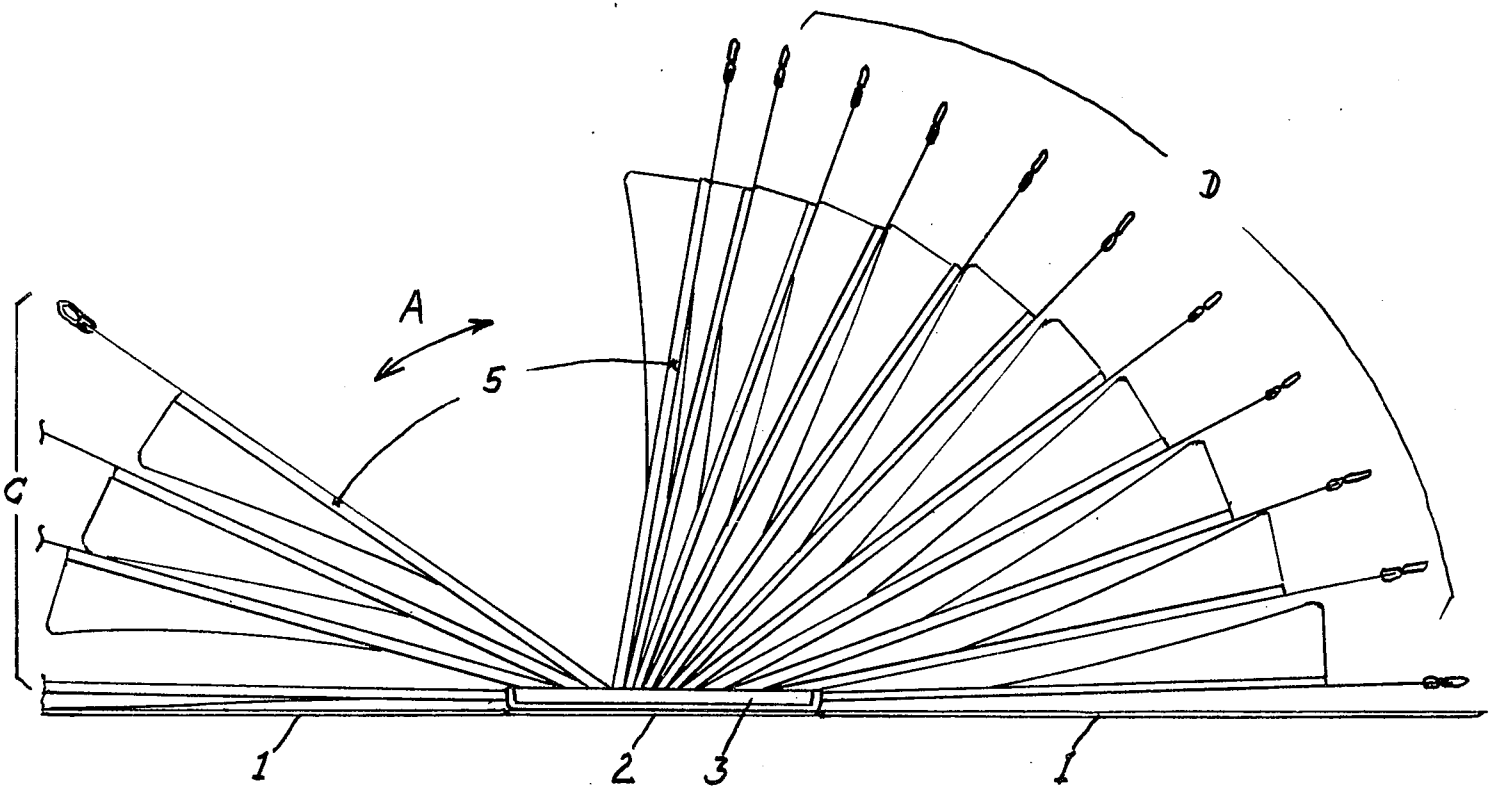
FIG. 1 illustrates in front elevation a binder according to the invention in its opened status.

The binder as shown in FIG. 1 comprises a front cover member and a rear cover member, each designated with 1. The cover members are hingedly connected, at their adjacent edges, to a back member 2. Extending in opening direction "A" of the binder, guidrails 3 are mounted at the upper and lower, respectively, short edge of back members 2. The guide rails have U-shaped section with their grooves facing each other. The guide rails serve as mounting means for a certain number of data carrier holders 5 shown in greater detail in FIG. 2 and 3. Each data carrier holder is provided, at its edge 6 adjacent the back member, with a mounting rod 7 extending beyond the end of said edge so that the rod end portions of all data carrier holders 5 may be held within the rail grooves. The number of pocket-like data carrier holders 5 is limited by the length of rails 3 such that the rods have, within the rail grooves, clearance to move along the rails. In result, whereever the binder is opened, the holders will fall laterally and remain in this position, as clearly illustrated in FIG. 1: Two piles "C" and "D", respectively, are formed.

Figure 2:
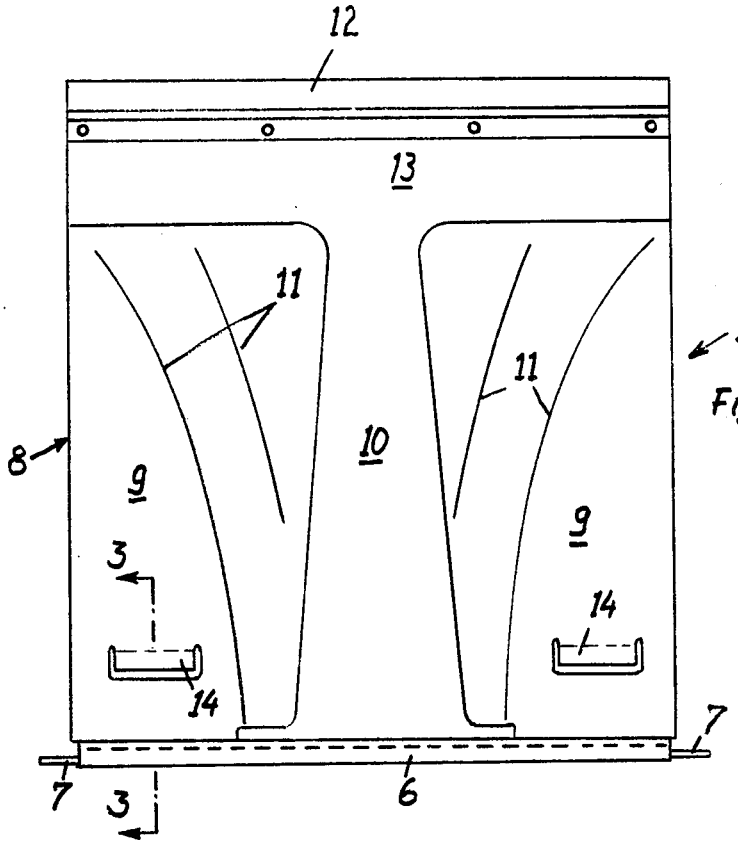
FIG. 2 shows one of the several data carrier holders as mounted in the binder of FIG. 1.
Figure 3:
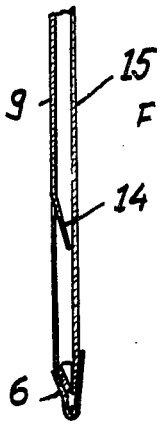
FIG. 3 is a section along line 3—3 of FIG. 2.

The individual holders comprise, as shown in FIG. 2, each a folder strip 8 of a plastic film material, terminal flaps 9 being folded inwardly such that their opposing edges are spaced by a distance 10. The flaps have a rounded corner and have been scored along two curved lines 11. The scores serve the purpose to make the flap corner portions spread away from the back of the holder so to create a pocket inlet which has a wider opening facilitating insertion of the respective data carrier. These flap corners further bias the entire binder in opening sense as clearly shown in FIG. 1. The individual holders 5 thus being spread apart, handling of the binder is greatly facilitated. Selection of particular holder or data carrier contained therein is further facilitated by a small longitudinal pocket 12 housing an information strip and mounted at an upper extension 13 of the strip 8.

In order to prevent premature slipping-off of the data carriers filed in the binder when the latter is opened, break means are provided. For this purpose, cuts are made in the flaps 9 adjacent rod 7 such that tongue members 14 are created deformed such that they biasedly abut the rear wall 15 of the holder pocket, the plastic material being in itself resilient.

A particular advantage of the binder of the invention is its economic manufacture because cutting of the strips, scoring of flaps and cutting of tongue members may all be done in one step simultaneously.

What I claim is:

1. A binder comprising a substantially rectangular flat front cover member, a substantially rectangular flat rear cover member, and a back member hingedly connecting said front cover member and said rear cover member along adjacent edges thereof, data carrier holders mounted at said back member by means of guide rails disposed at those back member edges which are not hingedly connected to said front cover member or said rear cover member, said guide rails being provided with straight grooves facing each other, rod means being provided at that data carrier holder edge which, when mounted at said back member, is adjacent thereto, said rod means extending beyond said holder edge and having end portions slidingly and pivotably received in said grooves, the number of data carrier holders mounted in said rails by means of said rod end portions being sufficiently small to leave a substantial amount of the guide rail length unoccupied for sliding movement of said end portions, each data carrier holder comprising a pocket member folded of resilient plastic film and having a substantially rectangular rear wall and two lateral front flaps whose opposing edges are spaced from each other, said front flaps being provided with score lines such that the flaps are biased away from said rear wall, said rod means axis being substantially perpendicular to said opposing flap edges, the bias of all flaps facilitating unfolding of said binder between two adjacent holders.

2. A binder as claimed in claim 1 in which each data carrier holder is provided, opposite said rod means, with a pocket apt to receive an information strip.

3. A binder as claimed in claim 1 in which said flaps are provided adjacent said rod means with tongue members cut of said flaps and biased towards said rear wall.

* * * * *